United States Patent [19]

Thomas

[11] Patent Number: 4,537,344

[45] Date of Patent: Aug. 27, 1985

[54] INTERLOCKING CORNER STRUCTURE ON TRAY FOR FROZEN FRUITS AND VEGETABLES

[75] Inventor: Gilles R. Thomas, Mortagne au Perche, France

[73] Assignee: International Paper Company, New York, N.Y.

[21] Appl. No.: 654,529

[22] Filed: Sep. 25, 1984

Related U.S. Application Data

[63] Continuation of Ser. No. 357,177, Mar. 11, 1982, abandoned.

[51] Int. Cl.[3] ..... B65D 5/22

[52] U.S. Cl. ..... 229/34 R; 229/31 FS; 229/34 B; 229/DIG. 2; 229/DIG. 11

[58] Field of Search ..... 229/32, 34 R, 34 B, 229/34 HW, 35, 31 FS, DIG. 2, DIG. 11

[56] References Cited

U.S. PATENT DOCUMENTS

| | | | |
|---|---|---|---|
| 2,233,874 | 3/1941 | Rosenthal . | |
| 2,980,309 | 4/1961 | Papas . | |
| 3,545,666 | 12/1970 | Visvydas . | |
| 3,704,823 | 12/1972 | Howe | 229/32 |
| 3,810,574 | 5/1974 | Gardner . | |
| 3,871,570 | 3/1975 | Garmon | 229/32 |
| 3,913,822 | 10/1975 | Heaps | 229/37 R |
| 3,940,053 | 2/1976 | Putman | 229/34 R |
| 3,973,723 | 8/1976 | Owens . | |
| 4,349,147 | 9/1982 | Jensen | 229/34 R |

FOREIGN PATENT DOCUMENTS

| | | | |
|---|---|---|---|
| 649484 | 11/1962 | Italy | 229/34 R |
| 1280673 | 7/1972 | United Kingdom | 229/34 R |
| 1475919 | 6/1977 | United Kingdom | 229/34 R |
| 1528491 | 10/1978 | United Kingdom | 229/31 FS |
| 1532277 | 11/1978 | United Kingdom | 229/34 R |
| 2043596 | 10/1980 | United Kingdom | 229/34 R |

*Primary Examiner*—William Price
*Assistant Examiner*—Gary E. Elkins
*Attorney, Agent, or Firm*—Bucknam and Archer

[57] ABSTRACT

A packing for forming a tray for transporting refrigerated, frozen, quick-frozen meat products, fruits and vegetables, and the like. The construction is such that the trays may be assembled from flat blanks at the time of use. The longitudinal and transverse walls of the assembled tray are formed such that their corrugations are aligned in parallel in the vertical direction so as to increase the strength of the packing in this direction and thus facilitate the stacking of trays. One embodiment of the invention comprises forming the tray with two thicknesses of cardboard on the longitudinal sides and three thicknesses of cardboard on the transverse sides.

3 Claims, 9 Drawing Figures

INTERLOCKING CORNER STRUCTURE ON TRAY FOR FROZEN FRUITS AND VEGETABLES

This application is a continuation of application Ser. No. 357,177, filed Mar. 11, 1982, now abandoned.

We are already familiar with the trays commonly used for transporting refrigerated, frozen, quick-frozen products or fruits and vegetables such as, for example, meat, giblets, etc., which require the use of recipients having high strength longitudinally and transversely, but also vertically, because such packings are stacked when stored, and transported, and owing to the particularly rigorous conditions of temperature and hygrometry, it is absolutely necessary that this vertical strength be very high in order to avoid crushing of any kind.

Attempts have been made to eliminate this drawback by the use of packings reinforced either by cutting in a special way to permit doubling the vertical sides forming the perimeter of the tray, or by using "double-double" corrugated cardboard, or corrugated cardboards in which the wall forming the interior of the packing is specialy treated, but none of these solutions has yielded the result sought for, and furthermore they are extremely troublesome owing to the fact that such packings can be used only one time and have to be destroyed when empty. But corrugated cardboards are made from imported woodpulp, which is expensive, and furthermore, the labor employed, which is highly specialized, is likewise expensive.

The present invention remedies these drawbacks, and creates a packing constituting a tray, reinforced in the parts that need to be strongest, this reinforcement being achieved with the aid of tabs or like elements suitably cut out to obtain the assembly of the tray, making it possible to deliver blanks flat so that the trays can be assembled at the time of use, this try being characterized by a cutout of the blank done in such a way that the lateral, longitudinal and transverse walls will be embodied with the corrugations of the cardboard disposed vertically so that the sttrength of the packing will be much higher when used full of refrigerated, frozen or quick-frozen products, or fruits and vegetables.

According to another characteristic of the invention, the packing is embodied from double-double corrugated cardboard.

Various other characteristics of the invention will become evident on reading the detailed description which follows.

A form of embodiment of the object of the invention is represented by way of example in the attached drawings.

Figure 1:
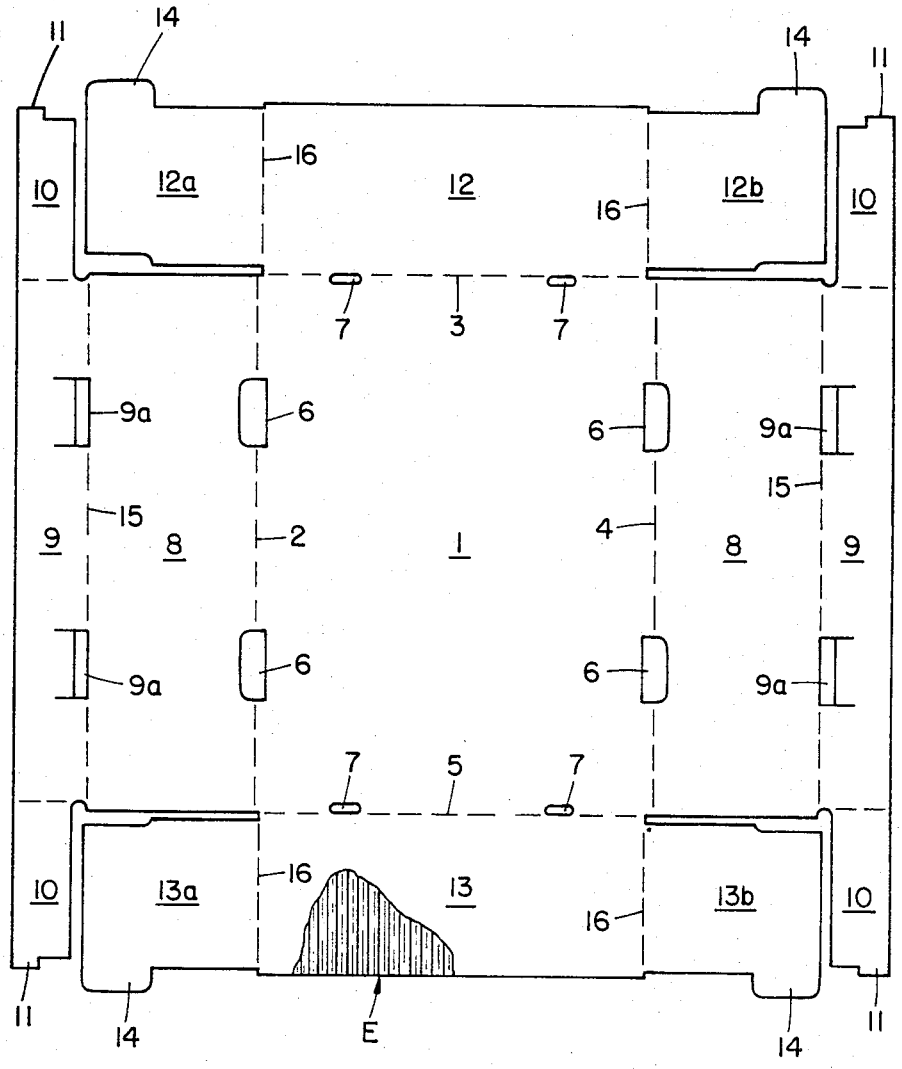
FIG. 1 is a plan of the blank, as cut out, which, after assembly, is to constitute the tray.

The bottom 1 of the tray is bordered by four fold lines 2, 3, 4, 5, having cutouts 6 for the lines bordering the longitudinal sides, and for the lines bordering the transverse sides, cutouts 7 whose function will be explained below.

Each longitudinal side of bottom 1 is prolonged, on the one hand by a tab 8 and on the other hand by a wing 9 to be folded over. These wings 9 are limited at the ends by small flaps 10 terminating in tenons 11. The transverse sides bordering bottom 1 are prolonged by tabs 12, 13, having wings 12*a*, 12*b*, 13*a*, 13*b*. These wings 12*a*, 12 *b*, 13*a*, 13*b*, are integral with tongues 14.

15 designates the fold lines between tabs 8 and wings 9, while the fold lines between tabs 12, 13 and wings 12*a*, 12*b*, 13*a*, 13*b* are designated by 16.

Since the blank is embodied in such a way that the corrugations of the cardboard are directed parallel to the length of the bottom 1 of the tray (see FIG. 1 at the exploded part E), the transverse tabs 12, 13 are therefore made of corrugated cardboard which, when these sides are raised vertically, have vertical corrugations, which substantially reinforce the crushing strength of the packing, especially when these packings are stacked to great heights and placed under very severe conditions of temperature and perhaps of humidity, as is the case of refrigerated, frozen, quick-frozen products, or fruits and vegetables.

As mentioned above, it is possible to use either simple cardboard to make these packings, or so-called double-double cardboard, which provides still better strength while avoiding an excessive cost price since the blank is produced, as is commonly the case, in a single pass of cutting and marking of the fold lines. But in the present case, the tray is obtained by a rectangular cardboard surface that is as small as is practically possible without falling, although having, for the longitudinal sides, whose elements are constituted by cardboard with horizontal corrugations, horizontal reinforcements formed by wings 9 and their flaps 10.

The inside of the packing forming a tray can, in certain cases, be specially coated, either in the course of manufacture of the corrugated cardboard, or after cutting out the blank, by a product that facilitates transportation and storage of meats, giblets etc. placed in the tray.

When the tray, which has been delivered flat, is to be assembled, it is only necessary to raise transverse sides 12, 13, pivot wings 12*a*, 12*b*, 13*a*, 13*b* 90° so that the latter will be parallel to fold lines 2 and 4, then raise longitudinal tabs 8, fold wings 9 horizontally so that tongues 14 will enter slots 9*a* precut in wings 9, and tenons 11 will enter notches 7 in bottom 1.

Figure 2:
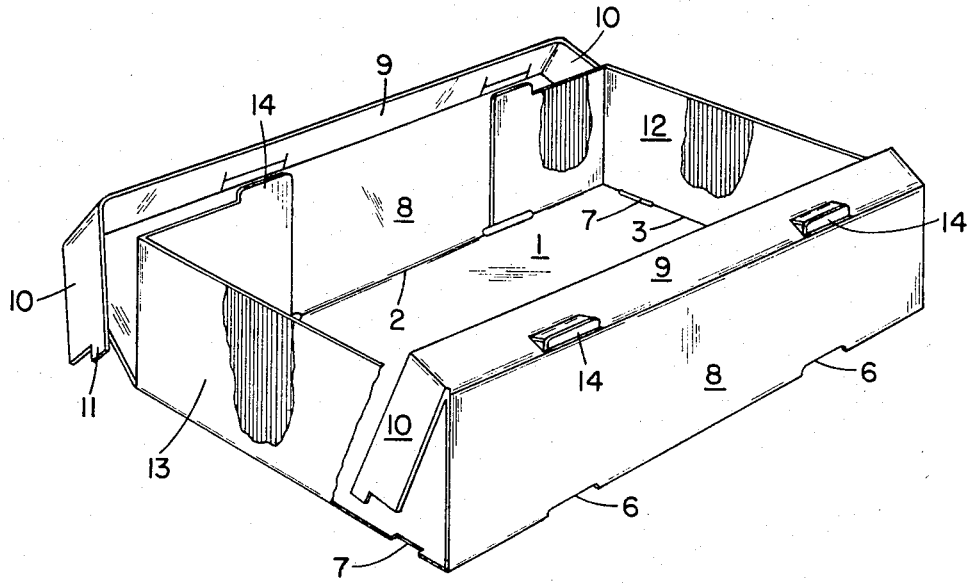
FIG. 2 is a perspective view, partly cut away, of a tray in the course of assembly.
Figure 3:
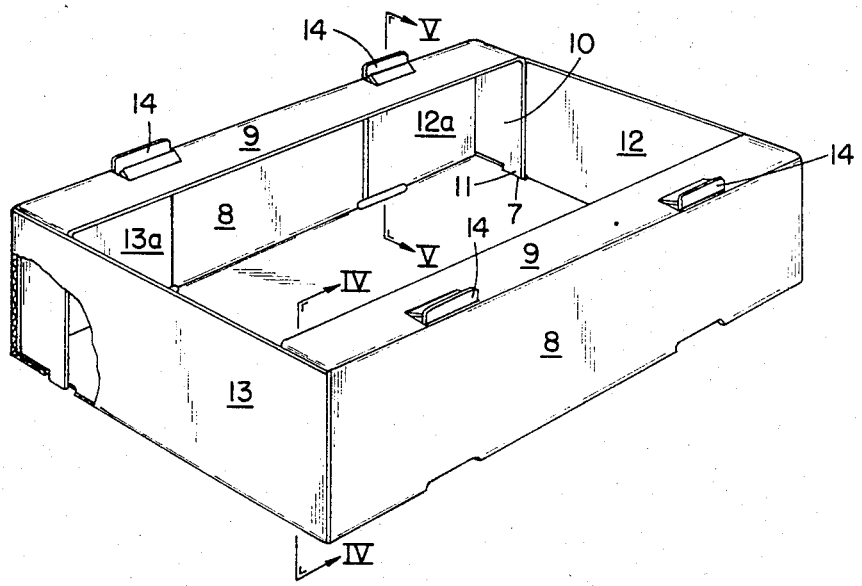
FIG. 3 is a perspective view, partly cut away, of the finished tray packing.
Figure 5:
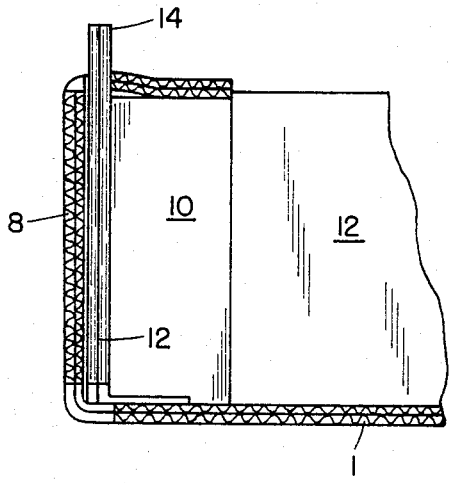
FIG. 5 is a section on a larger scale along line V—V in FIG. 3.
Figure 4:
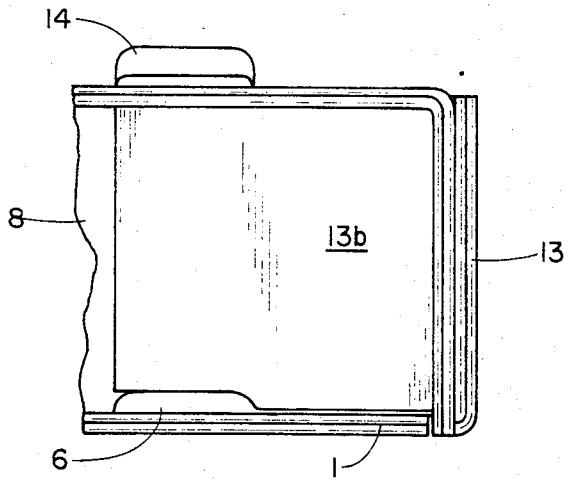
FIG. 4 is a section on a larger scale along line IV—IV in FIG. 3.

It will be obvious from an examination of FIGS. 2 and 3, that tongues 14 form vertical cleats which project beyond horizontal wings 9, and, with the aid of notches or the line 6 in bottom 1, lock the trays stacked on one another. In another embodiment of the invention, the packing forming a tray to contain refrigerated, frozen, quick-frozen products, fruits and vegetables, is composed of various walls which are embodied with the corrugations of the cardboard in the vertical position, then each corner of the tray is composed of two thicknesses of cardboard on the longitudinal sides and three thicknesses of cardboard on the transverse sides.

According to another characteristic, the three thicknesses of cardboard disposed transversely, are constituted by a tab integral with a longitudinal side, a sliding piece and a part of the trapezoidal surface forming the transverse side of the tray.

Figure 6:
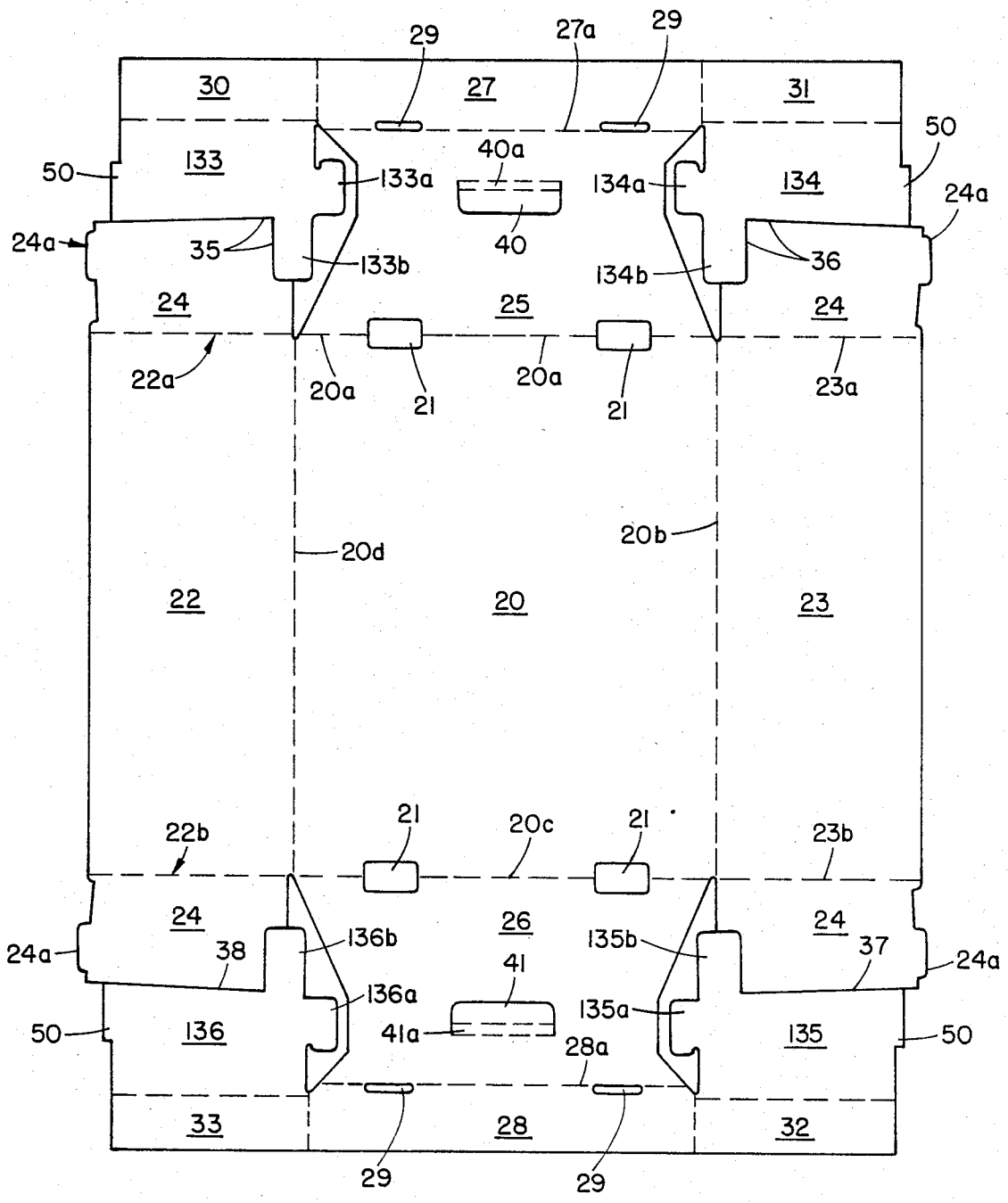
FIG. 6 is a plan view of the packing showing the blank before assembly of the tray.

FIG. 6, the tray is composed of a bottom 20 bordered by fold lines 20*a*, 20*b*, 20*c*, 20 *d*. In addition, along these transverse fold lines, slashes 21 are cut, disposed symmetrically to the longitudinal axis of the blank. The longitudinal sides of bottom 20 are prolonged by walls 22, 23 whose ends 22*a*, 22*b*, 23*a*, 23*b*, are integral, along fold lines, with tabs 24, each having a step 24*a*. As clearly seen in FIG. 1, the transverse sides of bottom 20 are prolonged by surfaces of substantially trapezoidal form 25, 26. These surfaces are likewise each prolonged, at their tops, by a flap 27, 28, each of which has a fold line 27*a*, 28*a*, along which there are slashes 29, substantially in line with slashes 21. Flaps 27, 28 are prolonged laterally by engagement pieces 30, 31, 32, 33 which bear, on their lower parts, sliding pieces 133, 134, 135, 136 having locking tongues 133*b*, 134*b*, 135*b*, 136*b*.

As clearly seen in FIG. 6, a cutting line 35 separates sliding piece 133 from tab 24, while a cutting line 36 separates sliding piece 134 from tab 24. The same is true for lines 37, 38, separating the sliding pieces 135, 136 from the other tabs 24. And finally, in each trapezoidal surface 25, 26, there are cutouts 40, 41, provided with a flap 40*a*, 41*a*, forming a handle.

Figure 7:
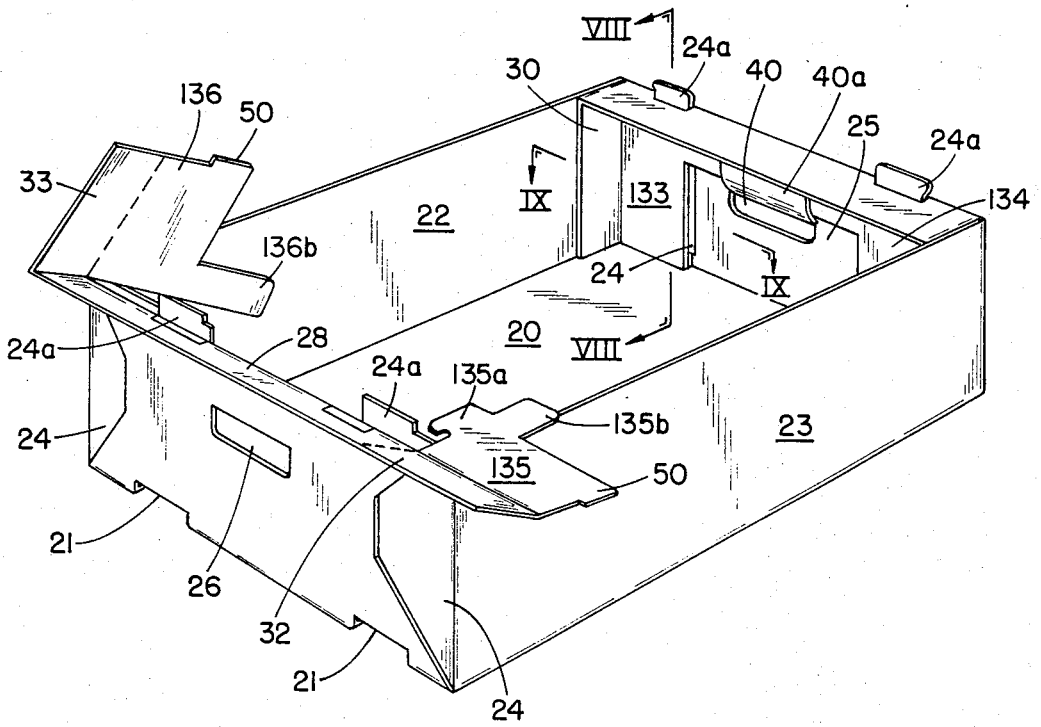
FIG. 7 is a perspective view of the tray being assembled.

As shown in FIG. 7, the lateral walls 22, 23 can easily be raised up to the vertical, and tabs 24 raised up perpendicularly along fold lines 22*a*, 22*b*, 23*a*, 23*b*.

The trapezoidal surfaces 25, 26 forming the transverse sides, are likewise raised up vertically, then flaps 27, 28 are raised horizontally. The sliding pieces 133, 134, 135, 136 are then inserted into the inside of the tray, parallel to tabs 24, along the latter, so that the feet 50 of sliding parts 133, 134, 135, 136 will penetrate into slashes 21, while locking pieces 133*a*, 134*a*, 135*a*, 136*a* will penetrate into slashes 29, to form centering elements for stacking the trays.

Care was taken, before this final assembly, to fold cutouts 40, 41 inward so as to double the zone of the handles.

Figure 8:
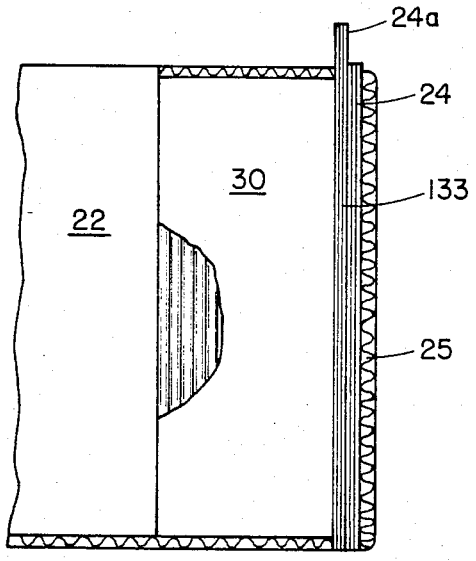
FIG. 8 is a section on a larger scale along line III—III in FIG. 7.
Figure 9:
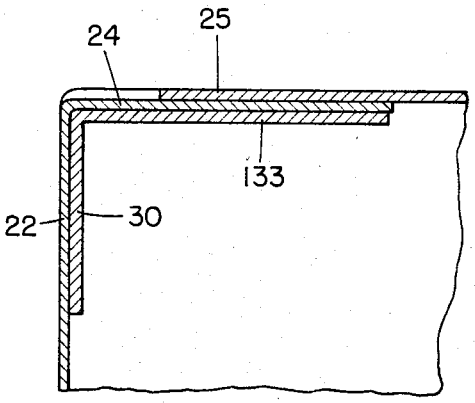
FIG. 9 is a section on a larger scale along line IV—IV in FIG. 7.

The tray is thus completely locked without glue or fasteners, and its corners are composed of three thicknesses of corrugated cardboard, whereof the corrugations are disposed vertically as seen in FIGS. 8 and 9, thereby insuring maximum crushing strength.

I claim:

1. A container blank, said blank comprising:

(a) a rectangular section;

(b) two walls each connected at fold lines to a longitudinal side of said rectangular section;

(c) two walls each connected at fold lines to a transverse side of said rectangular section;

(d) a plurality of tabs each connected at fold lines to one of the longitudinal walls of said rectangular section;

(e) a plurality of flaps each connected at fold lines to one of the transverse walls and whose outermost extremity constitutes an outermost boundary of said blank;

(f) a plurality of engagement pieces, each of whose outermost extremities is parallel to those of said flaps and which is integral with one of said flaps; and (g) a plurality of sliding pieces each of which is integral with a flap and each of which has appended thereto one or more feet, locking pieces, and locking tongues, said feet and locking pieces, respectively, being appended to opposed edges of said sliding pieces, said transverse walls and said rectangular section having abutting indentations which form one or more holes at their points of intersection and said flaps having one or more holes adjacent their intersection with said transverse walls.

2. A tray, said tray being capable of being assembled at the time of use from a flat blank, said tray comprising:

(a) a bottom;

(b) a plurality of walls each connected at fold lines to one of the longitudinal sides of said bottom;

(c) a plurality of walls each connected at fold lines to one of the transverse sides of said bottom;

(d) a plurality of tabs each connected at fold lines to one of the longitudinal walls, said tabs having parallel corrugations aligned vertically in the assembled tray; and wherein said assembled tray has two thicknesses of corrugated cardboard on each longitudinal side and three thicknesses of corrugated cardboard on each transverse side, and wherein the three thicknesses of corrugated cardboard on each transverse side comprise one of said tabs connected to said longitudinal walls attached to said bottom, one of said transverse walls, and a sliding piece integrally connected to an engagement piece which has one of its outer extremities parallel to and integral with a flap which is integral with one of the transverse walls of said tray and whose outermost extremity constitutes an outermost boundary of said blank, said sliding piece having one or more feet appended thereto which feet respectively penetrate into one or more holes formed by abutting indentations on said bottom and one of said transverse walls and said sliding piece having one or more locking pieces appended thereto which locking pieces respectively penetrate into one or more holes formed by an indentation on said flap.

3. The tray of claim 2, further comprising said sliding piece having one or more tongues which are parallel to said transverse walls and project inward relative to said longitudinal walls in said assembled tray.

* * * * *